US012194362B2

(12) United States Patent
Chen

(10) Patent No.: US 12,194,362 B2
(45) Date of Patent: Jan. 14, 2025

(54) DUMBBELL AND BARBELL SUPPORTING SYSTEM

(71) Applicant: Paul Chen, Taichung (TW)

(72) Inventor: Paul Chen, Taichung (TW)

(73) Assignee: FLORIEY INDUSTRIES INTERNATIONAL CO., LTD.

( * ) Notice: Subject to any disclaimer, the term of this patent is extended or adjusted under 35 U.S.C. 154(b) by 143 days.

(21) Appl. No.: 18/121,006

(22) Filed: Mar. 14, 2023

(65) Prior Publication Data

US 2024/0307752 A1 Sep. 19, 2024

(51) Int. Cl.
*A63B 71/00* (2006.01)
*A63B 21/072* (2006.01)

(52) U.S. Cl.
CPC ..... *A63B 71/0036* (2013.01); *A63B 21/0724* (2013.01); *A63B 21/0726* (2013.01)

(58) Field of Classification Search
CPC ..... A63B 21/0722; A63B 21/0724; A63B 21/0726; A63B 71/0036
See application file for complete search history.

(56) References Cited

U.S. PATENT DOCUMENTS

| | | | | |
|---|---|---|---|---|
| 7,022,053 | B2 * | 4/2006 | Whetstone | A63B 71/0036 482/92 |
| 9,717,943 | B2 * | 8/2017 | Klonoski | A63B 71/0036 |
| 11,103,739 | B2 * | 8/2021 | Shaw, Jr. | A63B 23/12 |
| 11,260,270 | B1 * | 3/2022 | Owusu | A63B 71/0036 |
| 11,273,338 | B2 * | 3/2022 | Chen | A63B 71/0036 |
| 2020/0306578 | A1 * | 10/2020 | Pohl | A63B 21/0724 |
| 2021/0146187 | A1 * | 5/2021 | Chen | A63B 21/0726 |
| 2021/0187341 | A1 * | 6/2021 | Chen | A63B 21/0724 |
| 2021/0322815 | A1 * | 10/2021 | Chen | A63B 21/078 |
| 2023/0016579 | A1 * | 1/2023 | Chen | A63B 21/0728 |

* cited by examiner

*Primary Examiner* — Zachary T Moore

(57) ABSTRACT

A dumbbell and barbell supporting system is disclosed. A first embodiment includes a main support, two support members, and placement bases; when the placement bases located in the same support member are moved away from each other, two ends of the dumbbell are mounted in the placement bases to combine with weight element group; when the placement bases located in the same support member are moved close to each other, one weight element group is combined with another weight element group to convert a dumbbell to a barbell. In a second embodiment, the placement bases located in the same support member are connected by connection assembly; before the conversion to the barbell, the dumbbell, the connection assembly and the placement base are taken away from the support member to combine with the weight element group, so that the barbell can be put in placement slots.

10 Claims, 18 Drawing Sheets

DUMBBELL AND BARBELL SUPPORTING SYSTEM

BACKGROUND OF THE INVENTION

1. Field of the Invention

The present invention is related to a dumbbell and barbell supporting system, and particularly to the technology applied in the field of fitness equipment.

2. Description of the Related Art

A shelf that can support a dumbbell and a barbell is launched on the market, for example, Taiwan new model patents No. M613036 and M635083 disclose dumbbell and barbell supporting systems having characteristics of using complex structures to form support devices, support frames and the matching mechanisms. To perform the conversion between a dumbbell and a barbell in the dumbbell and barbell supporting system, a user must first adjust and move the support device and support frame, but this process is a kind of burden for the users who pursuit convenience. For the manufacturer, too many and complex structure composition is one of the main deficiencies that increase the overall cost, and may easily cause parts miss, damage during the manufacturing process and also result in longer working hours and other drawback.

SUMMARY OF THE INVENTION

An objective of the present invention is to enable a user to operate a conversion between a dumbbell and a barbell more smoothly and conveniently, and also enable a manufacturer to save more cost in manufacturing process and decrease working hour in manufacturing process.

In order to achieve the objective, the present invention mainly discloses two embodiments. A first embodiment is a dumbbell and barbell supporting system, include a main support, two support members and placement bases. The main support includes two foot parts, and a rod connected to the two foot parts, wherein the two foot parts are disposed on two ends of the rod, respectively. The two support members are mounted on two ends of the rod and opposite to the two foot parts, respectively, wherein each of the two support members has a placement slot recessed on a top thereof toward a bottom thereof, the placement slot has an opening formed on a bottom thereof, and a part of the rod is exposed out of the opening. The placement bases are mounted in the placement slot, inserted through the opening and slidably assembled with the rod, wherein some of the placement bases disposed in one of the two support members are movable close to and away from each other along an arrangement direction of the rod, to perform conversion between a dumbbell and a barbell, wherein a weight element group is movably disposed between one of the placement bases and a sidewall of a closest one of the two placement slots.

A second embodiment is a dumbbell and barbell supporting system, includes a main support, two support members and placement bases. The main support includes two foot parts, and a rod connected to the two foot parts, wherein the two foot parts are disposed on two ends of the rod, respectively. The two support members are mounted on two ends of the rod and opposite to the two foot parts, wherein each of the two support members has a placement slot recessed on a top thereof toward a bottom thereof. The placement bases are mounted in the two placement slots, respectively, wherein some of the placement bases disposed in one of the two support members are connected to a connection assembly, and weight element groups are movably mounted in two sides of one of the placement slots, respectively, two ends of a dumbbell are placed in the placement bases in one of the two support members and movably connected to the weight element groups, respectively, wherein before the conversion from the dumbbell to a barbell, the dumbbell, the connection assembly and the placement base together are taken away from the one of the two support members, and moved and arranged in parallel to combine the weight element groups, and two ends of the barbell is put in the placement slots to movably connect to the weight element groups, respectively.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
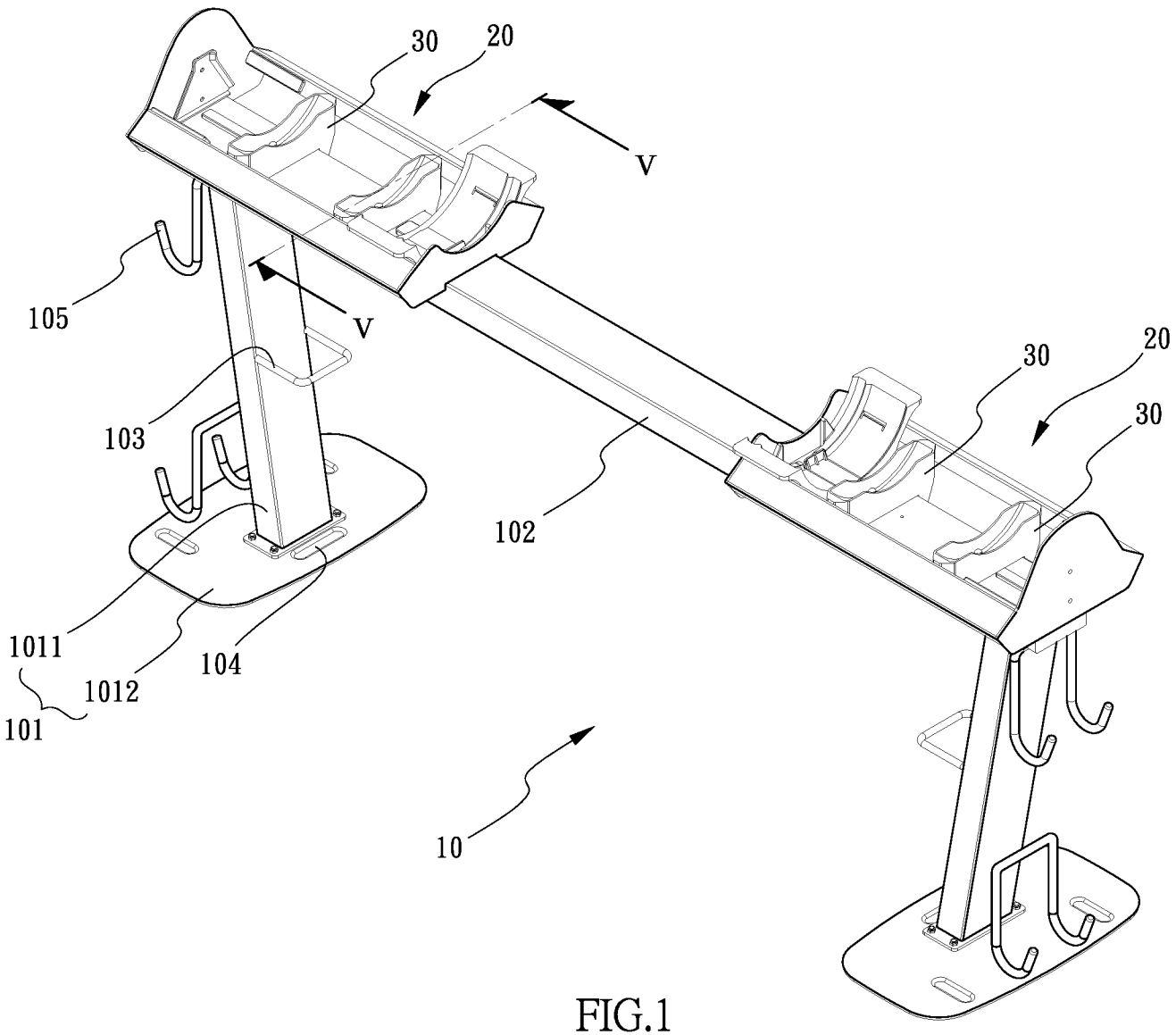
FIG. 1 is a perspective view of a first embodiment of the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims.

These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts. As used herein, the singular forms "a", "an" and "the" are intended to include the plural forms as well, unless the context clearly indicates otherwise.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the words "comprise" and "include", and variations such as "comprises", "comprising", "includes", or "including", will be acknowledged to imply the inclusion of stated elements but not the exclusion of any other elements.

Please refer to FIG. 1 to FIG. 18. FIG. 1 to FIG. 10 illustrate a first embodiment, and FIG. 11 to FIG. 18 illustrate a second embodiment. A dumbbell and barbell supporting system of the first embodiment of the present invention will be illustrated in the following paragraphs. The dumbbell and barbell supporting system includes a main support 10, two support members 20 and placement bases 30. The main support 10 has two foot parts 101 and a rod 102 connected to the two foot parts 101. An end of each of the two foot parts 101 is connected to a corresponding one of two ends of the rod 102, and another end of the each of the two foot parts 101 stands on the ground. The two support members 20 are configured to support an end of one of a dumbbell 100 and a barbell 200. The two support members 20 are mounted on two ends of the rod 102 and opposite to the two foot parts 101, respectively; each of the two support members 20 has a placement slot 201 recessed on a top thereof toward a bottom thereof, and the placement slot 201 has an opening 202 formed on a bottom thereof. A part of the rod 102 is exposed out of the opening 202. The placement bases 30 are mounted in the placement slots 201 and inserted through the openings 202 to slidably connect to the rod 102, respectively. The placement bases 30 disposed in the same support member 20 can be moved close to or away from each other along an arrangement direction of the rod 102, to perform a conversion between the dumbbell 100 and the barbell 200 for use. A weight element group 300 is movably disposed between one of the placement bases 30 and a sidewall of a placement slot 201 closest to the one of the placement bases 30.

After the operation of the dumbbell 100 is completed, a user can place the dumbbell 100 aside and control the placement bases 30 in each of the two support members 20. The support member 20 in left parts of FIG. 7 to FIG. 10 is taken as an example for illustration. After the dumbbell 100 is separated, the placement base 30 in a left-hand side of the support member 20 is controlled to move toward and get closer to the placement base 30 in a right-hand side of the support member 20; next, the user lifts the weight element group 300 in the right-hand side and turn to the weight element group 300 in a left-hand side, to combine the two weight element groups 300. After the user combines the two weight element groups 300 completely, the user lifts the barbell 200 from below to above the main support 10, and two ends of the barbell 200 are placed in the corresponding placement bases 30, respectively; next, the user adjusts the number of pieces of the weight element groups 300 to combine with the barbell 200 according to a loadable weight of the user. In the other hand, in order to convert the barbell 200 into the dumbbell 100, the user just needs to separate the placement base 30, which are closer to each other, according to above-mentioned steps.

Please refer to FIG. 2 to FIG. 5, each of the two support members 20 further includes two stop boards 203 and two stop rods 204, each of the two stop rods 204 is a strip body in an inverted-U shape, the two stop boards 203 are arranged in interval and corresponds in position to each other, and two ends of each of the two stop rods 204 are connected to the two stop boards 203, respectively. The connection between the two stop boards 203 and the two stop rods 204 form a placement slot 201 with an opening 202, each of the two stop rods 204 has a fastening part 2041, two ends of each of the placement bases 30 are engaged with the fastening parts 2041, respectively, so that two ends of each placement base 30 can be firmly engaged with the stop rod 204; furthermore, the placement bases 30 are mounted in the rod 102, so the placement bases 30 can be smoothly moved.

Figure 5:
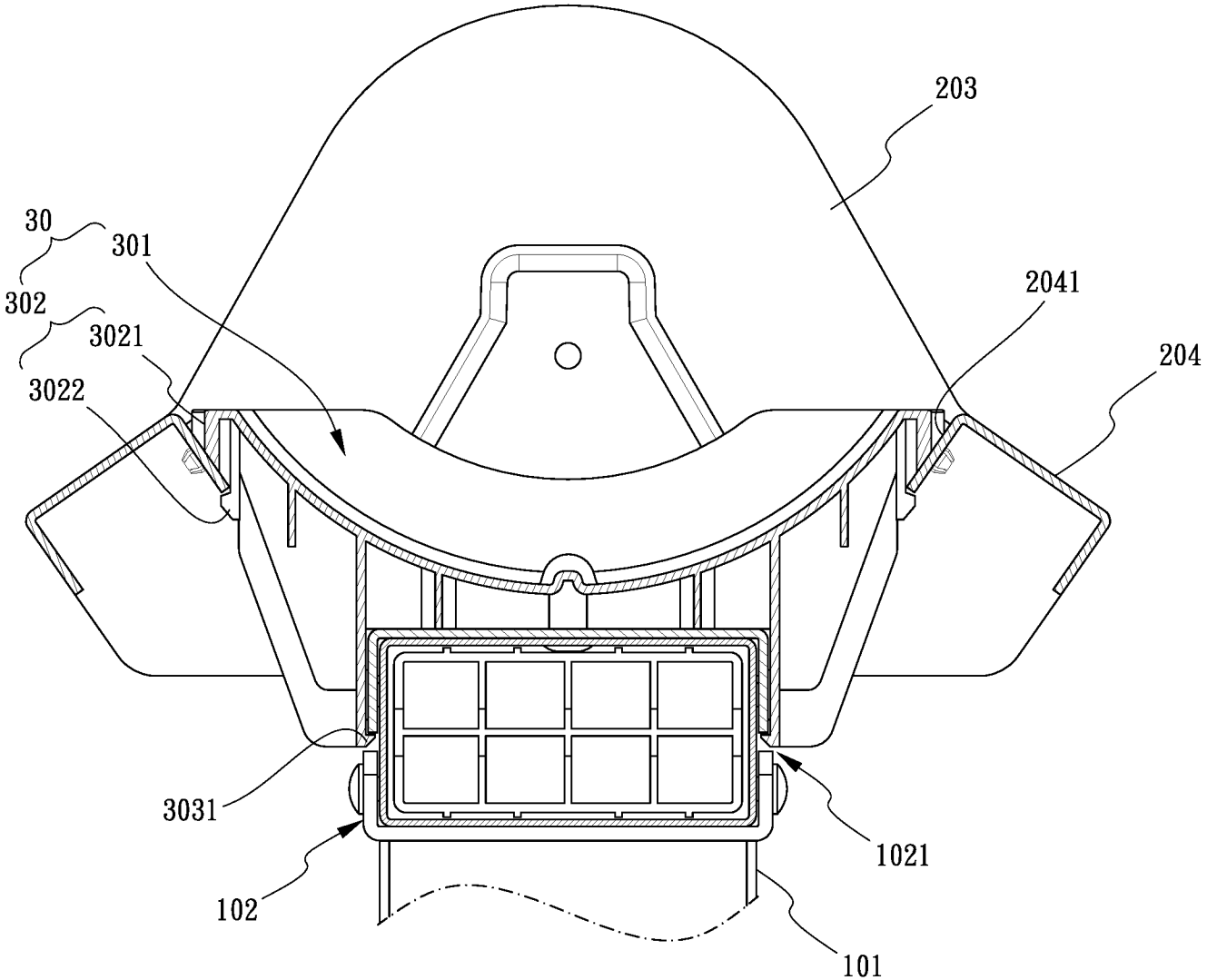
FIG. 5 is a schematic cross-sectional view taken along V-V of FIG. 1.
Figure 6:
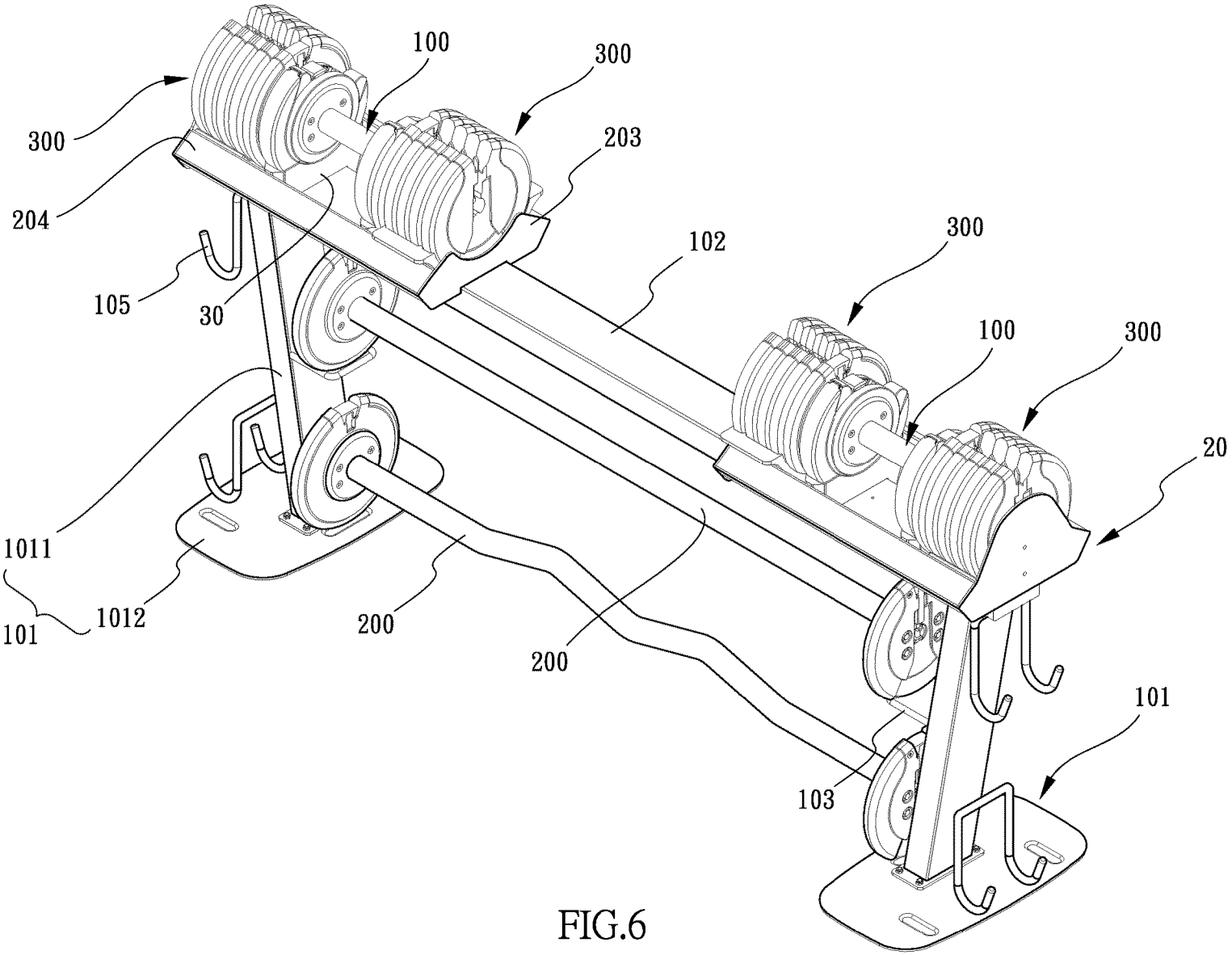
FIG. 6 is a schematic view of a usage status of a first embodiment of the present invention.
Figure 7:
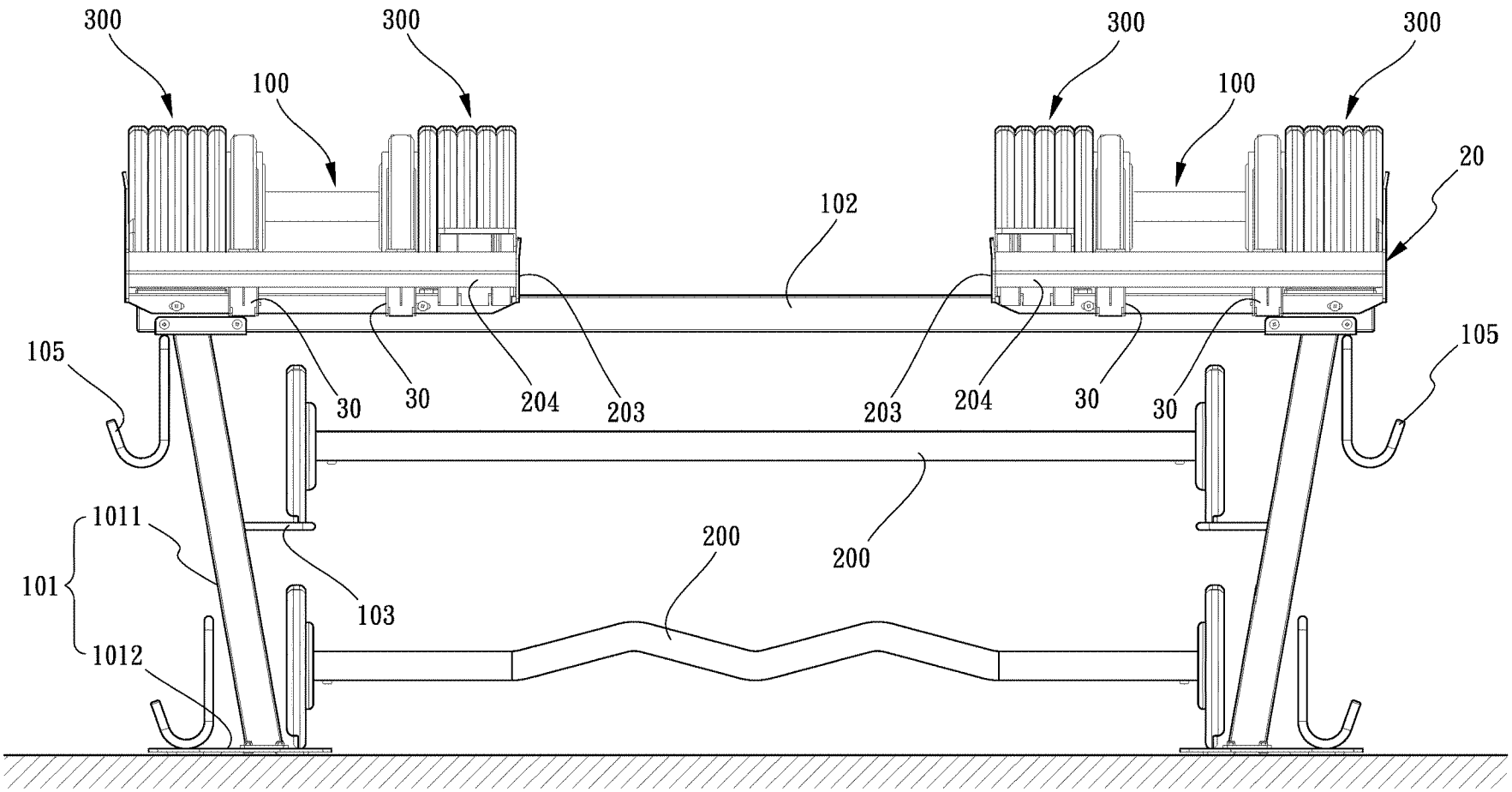
FIG. 7 is a schematic plan view of FIG. 6.
Figure 8:
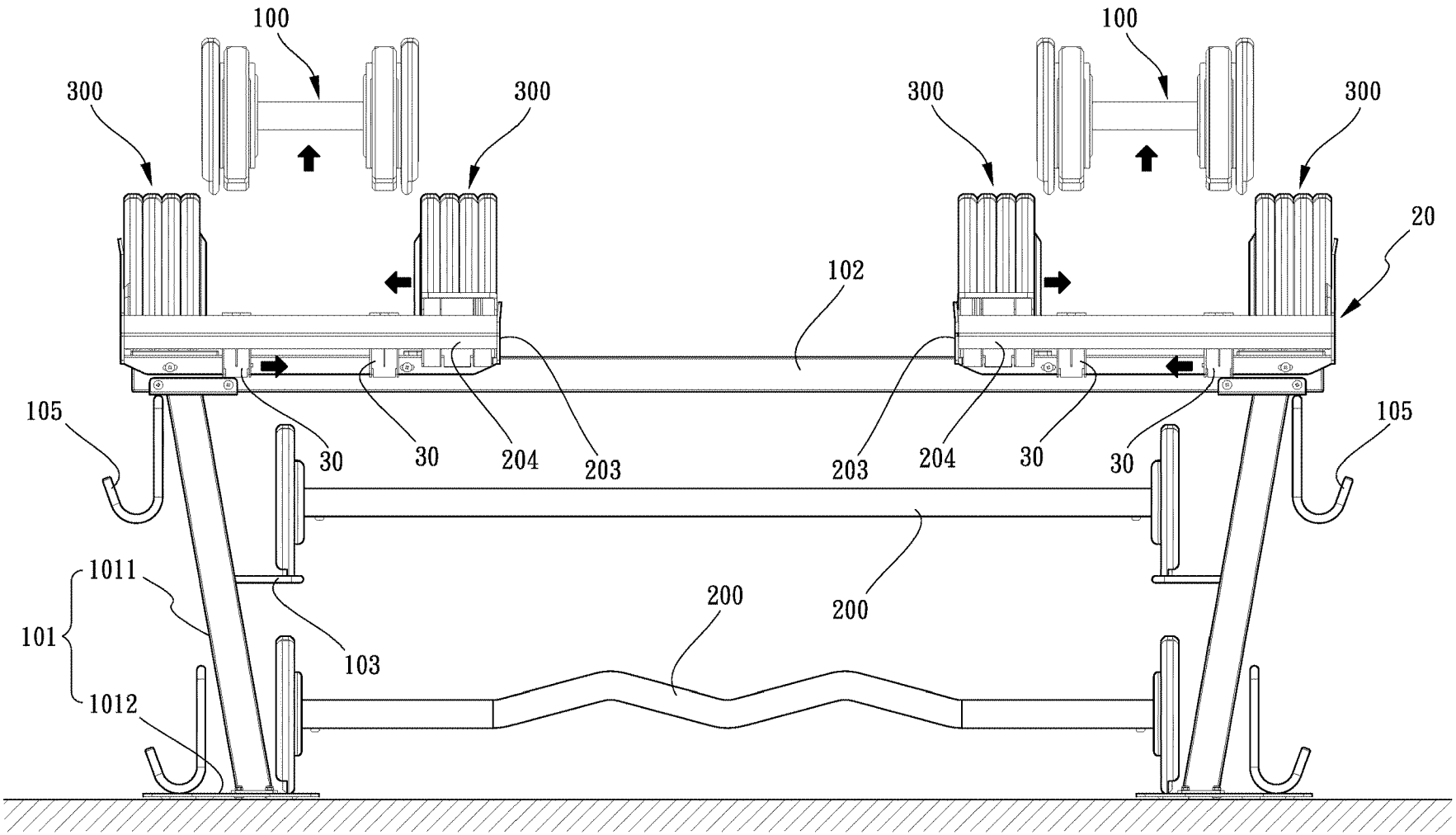
FIG. 8 is a schematic view showing an operation of upwardly separating the dumbbell of FIG. 7 from a placement base.
Figure 9:
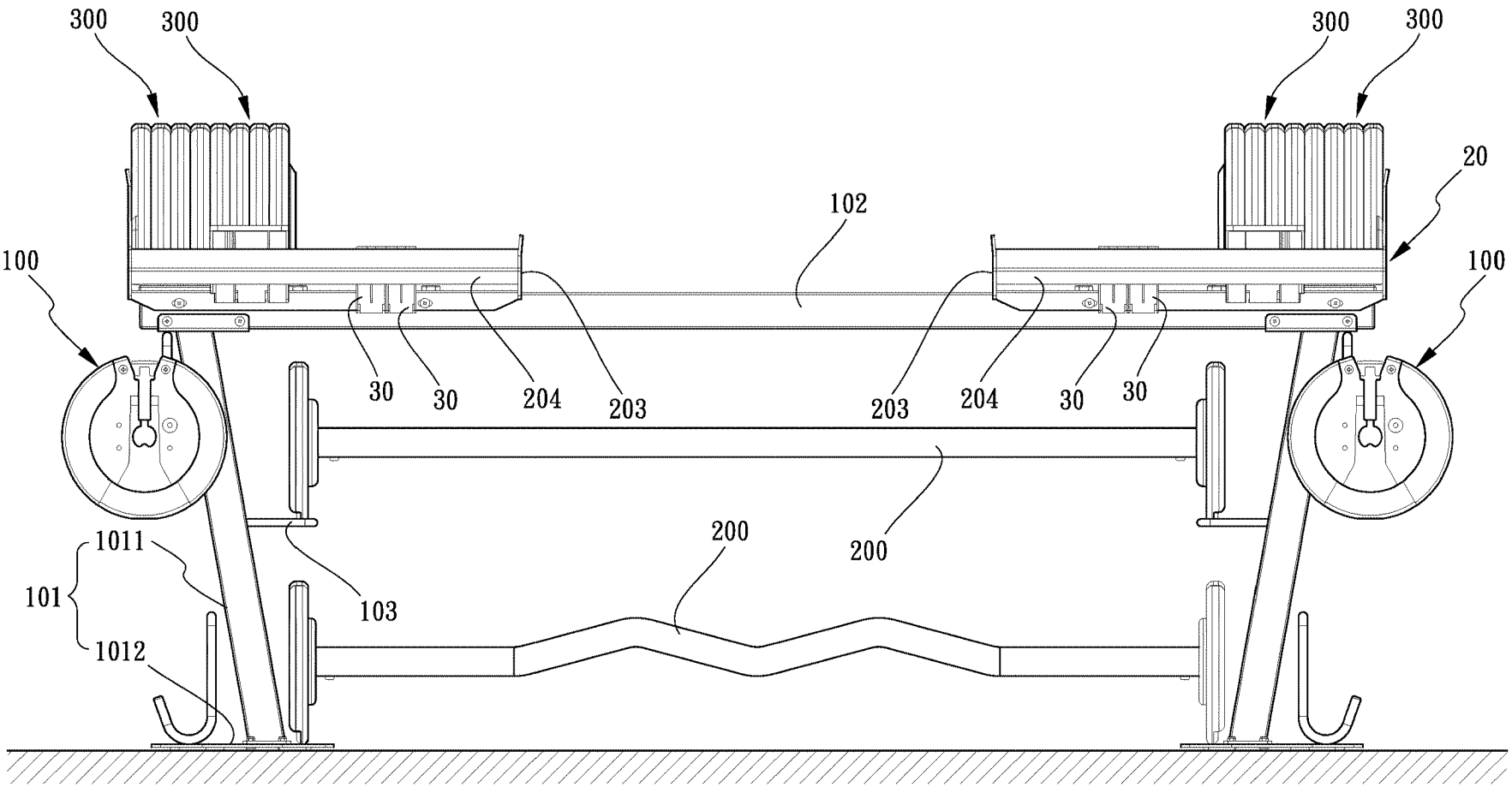
FIG. 9 is a schematic view showing an operation of moving one of placement bases and moving one of weight element groups of FIG. 8.
Figure 10:
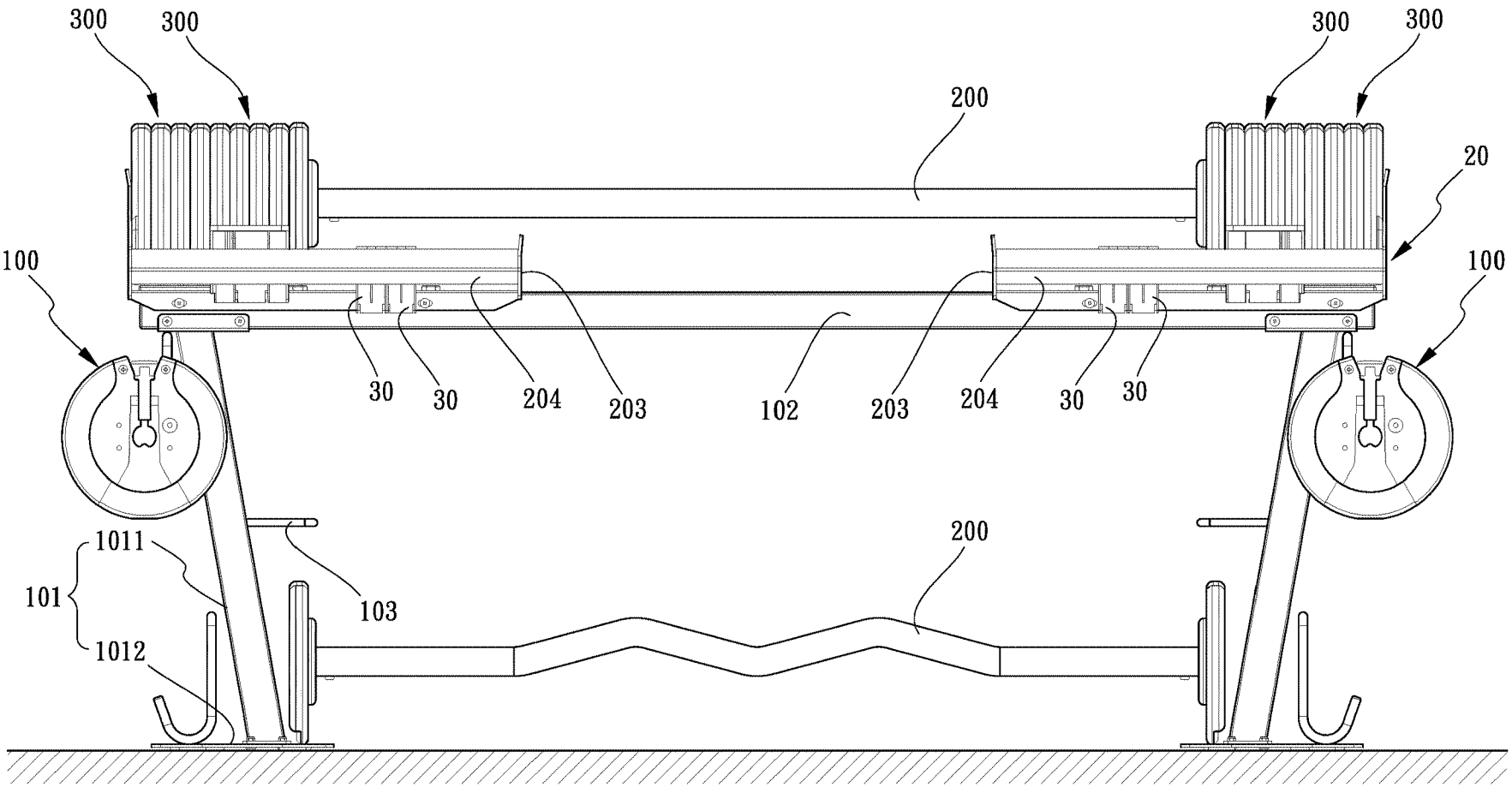
FIG. 10 is a schematic view of a usage status of the barbell of FIG. 9 that is upwardly moved to combine with weight element groups.
Figure 11:
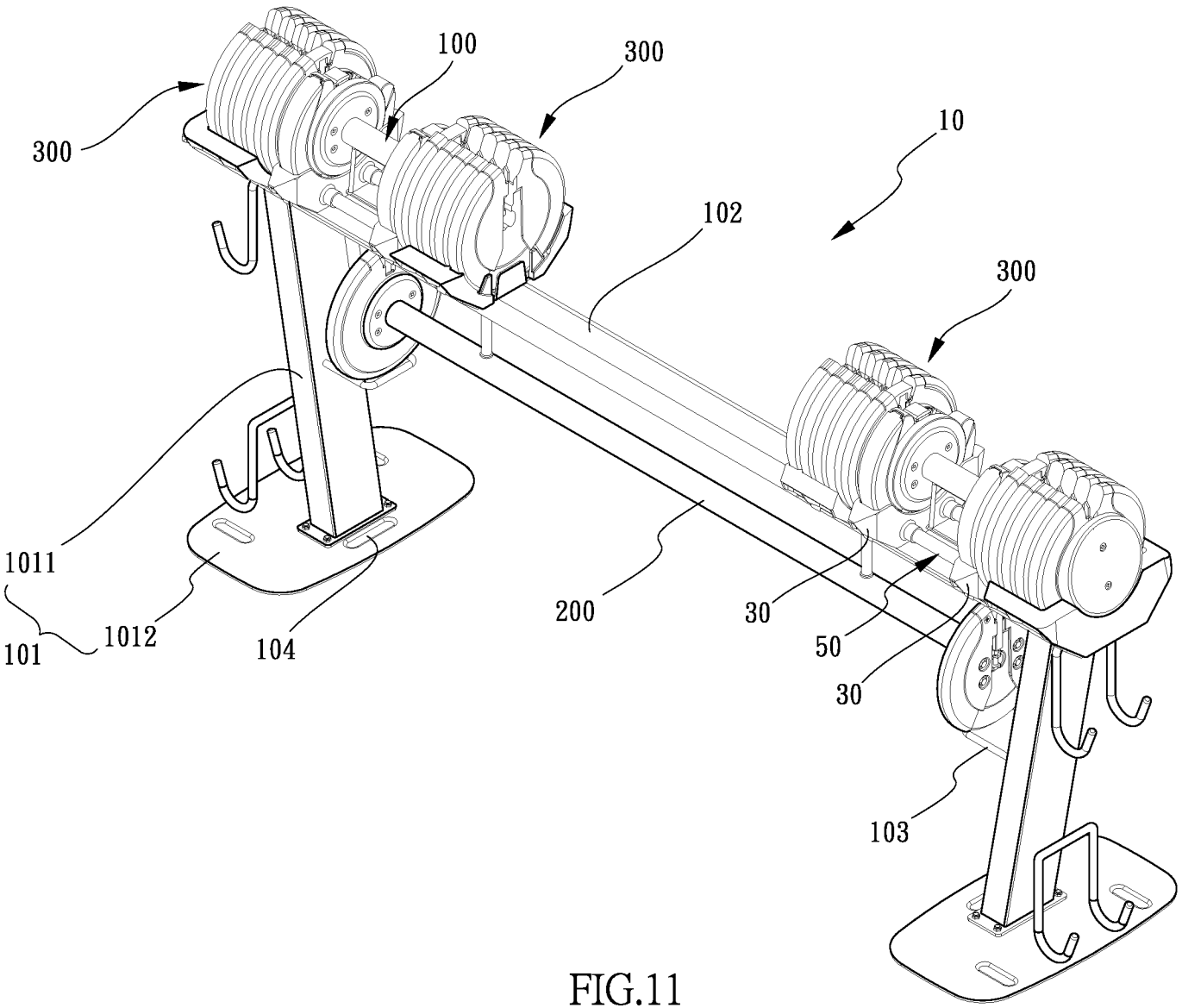
FIG. 11 is a perspective view of a second embodiment of the present invention.
Figure 12:
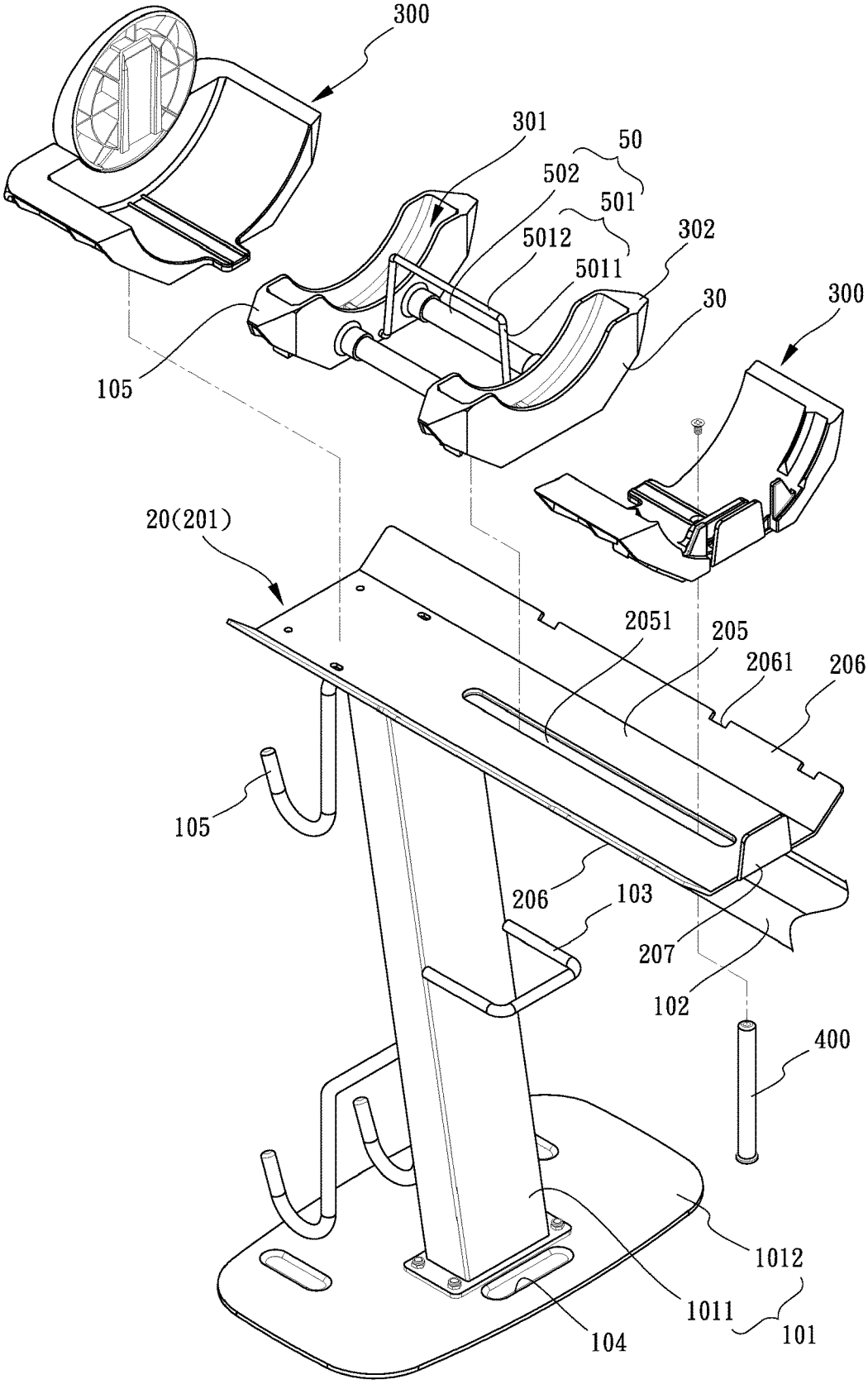
FIG. 12 is a perspective exploded view of a part of a second embodiment of the present invention.
Figure 13:
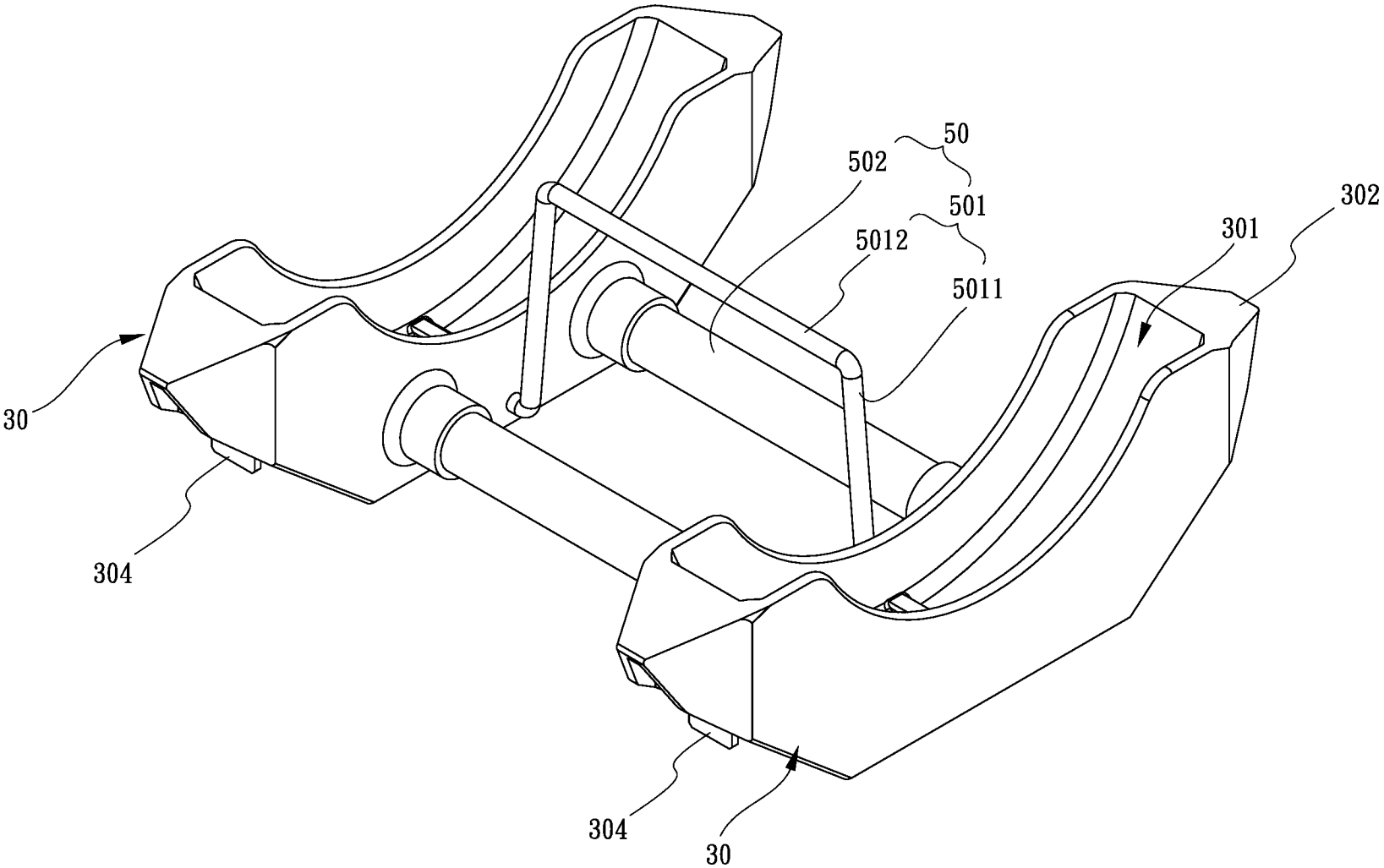
FIG. 13 is a perspective view of placement bases and a connection assembly of a second embodiment of the present invention.
Figure 14:
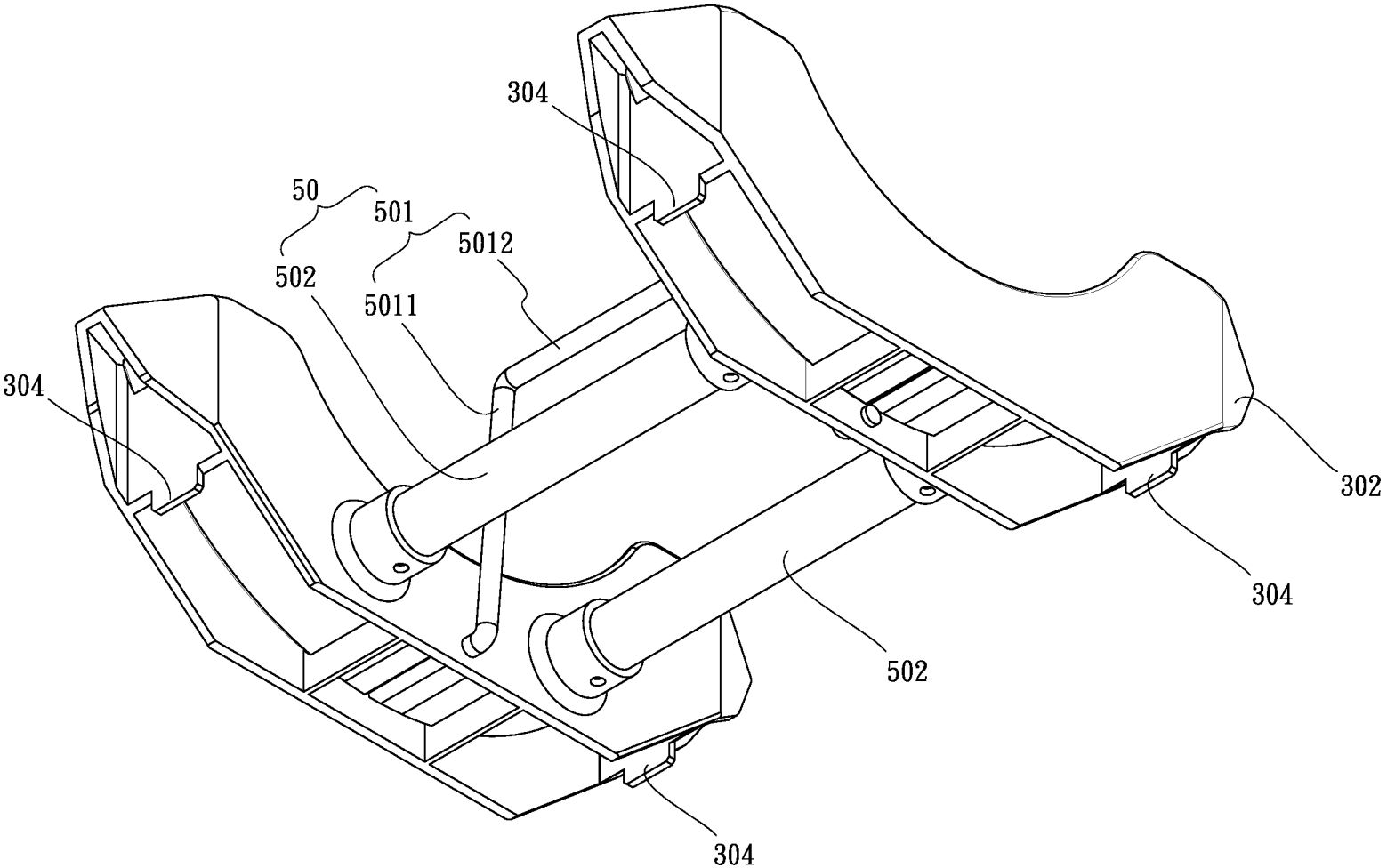
FIG. 14 is a perspective view of FIG. 13, when viewed from another angle.
Figure 15:
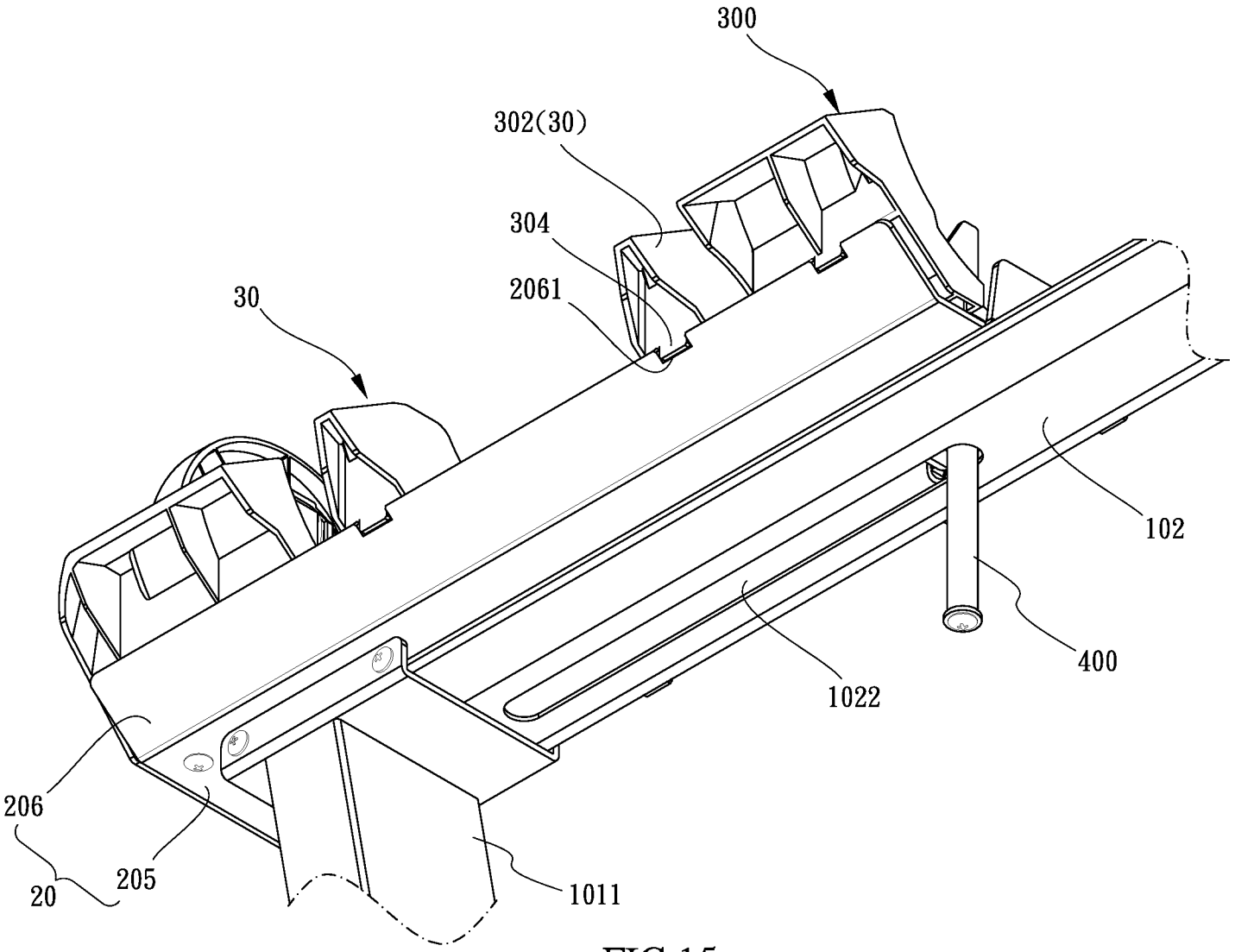
FIG. 15 is an enlarged view of a part of FIG. 11, when viewed from another angle.
Figure 16:
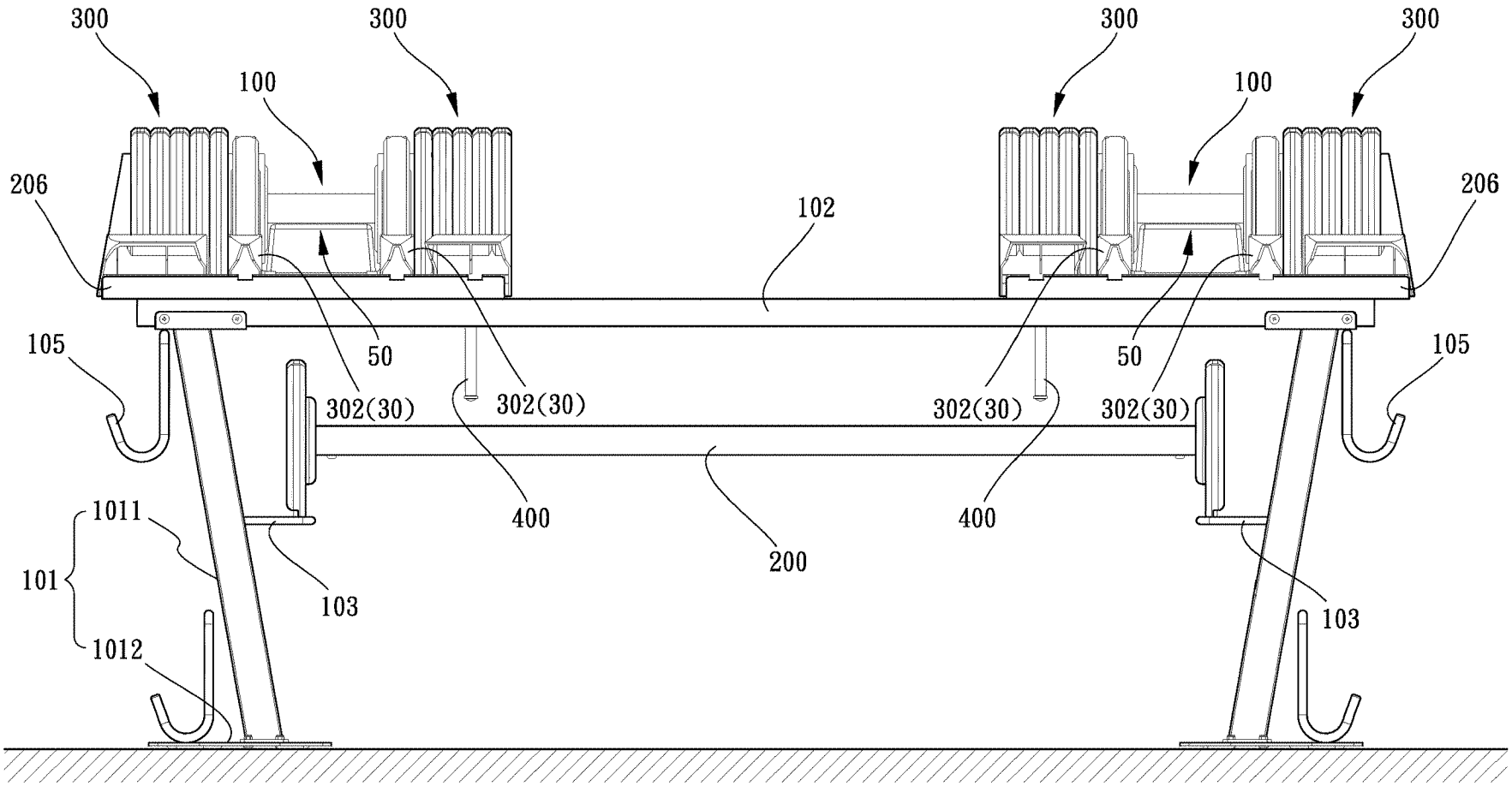
FIG. 16 is a schematic plan view of a second embodiment of the present invention.
Figure 17:
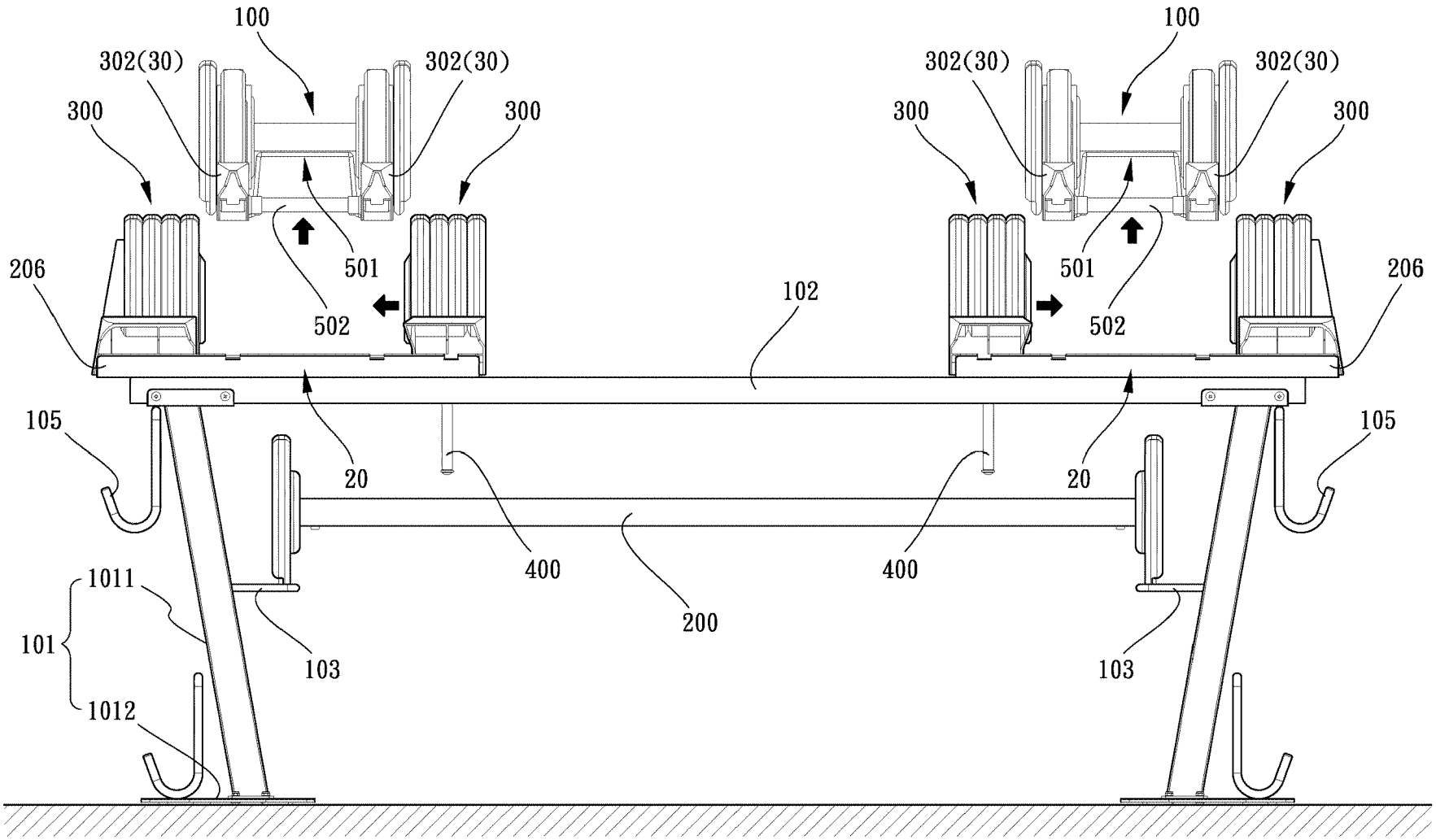
FIG. 17 is a schematic view showing an operation of taking the placement bases, the connection assemblies and the dumbbells of FIG. 16 for separation.
Figure 18:
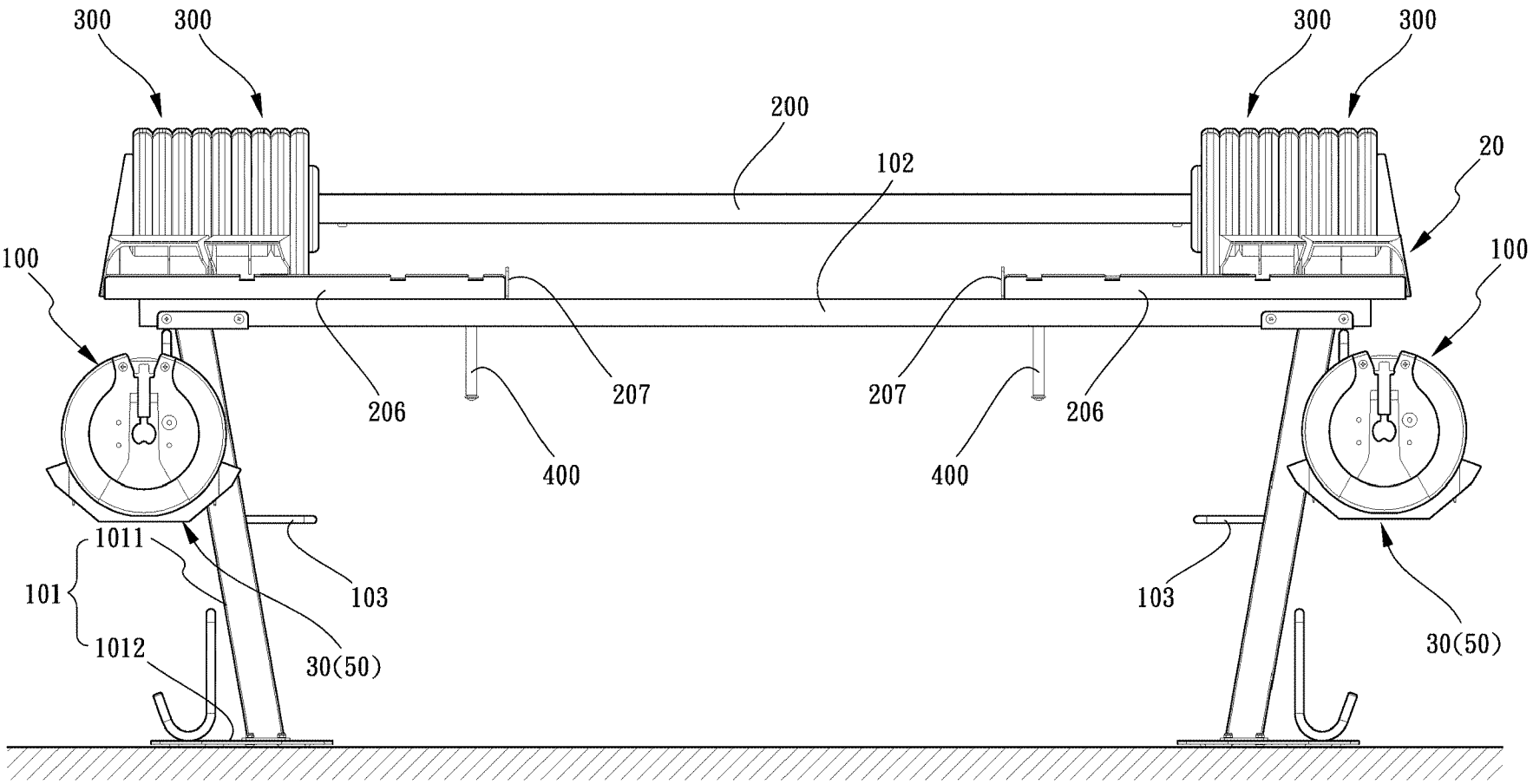
FIG. 18 is a schematic view of an operation of moving one of the weight element groups of FIG. 17 to assemble with another weight element group, and moving the barbell from down to up to combine with weight elements.

Each placement base 30 includes a placement groove 301 recessed on a top thereof, two blocking parts 302, and two clamping parts 303 opposite to the placement groove, respectively. The placement groove 301 is configured to support the weight elements on two ends of the dumbbell 100 or the barbell 200, and the two blocking parts 302 are disposed on two ends of the placement base 30, and configure to engage with the fastening parts 2041, respectively. The two clamping parts 303 are protruded on bottom of the placement base 30 and slidably connected to two ends of the rod 102, respectively. Each of the two blocking parts 302 includes an abutting rib 3021 and a hooking block 3022. The abutting rib 3021 of each of the two blocking parts 302 is abutted with a surface of a corresponding fastening part 2041, and each hooking block 3022 is engaged with a distal end of the corresponding fastening part 2041, so that the abutting ribs 3021 of the two blocking parts 302 are in contact with the fastening parts 2041, the hooking blocks 3022 are engaged with bottoms of the fastening parts 2041, respectively, and this multi-direction restriction can prevent the placement base 30 from shaking during movement, as shown in FIG. 5. The rod 102 has at least one sliding rail 1021 recessed correspondingly in position to the clamping parts 303, an end of each clamping part 303 is connected to the bottom of the corresponding placement base 30, another end of each clamping part 303 is extended toward two sides of the rod 102, and the extended end of the clamping part 303 has a slider 3031 protruded thereon, the sliders 3031 are inserted into the sliding rails 1021 on two sides of the rod 102, respectively. The slider 3031 protruded on the clamping part 303 is inserted into the corresponding sliding rail 1021, so that the slider 3031 is movable along the sliding rail 1021.

Figure 2:
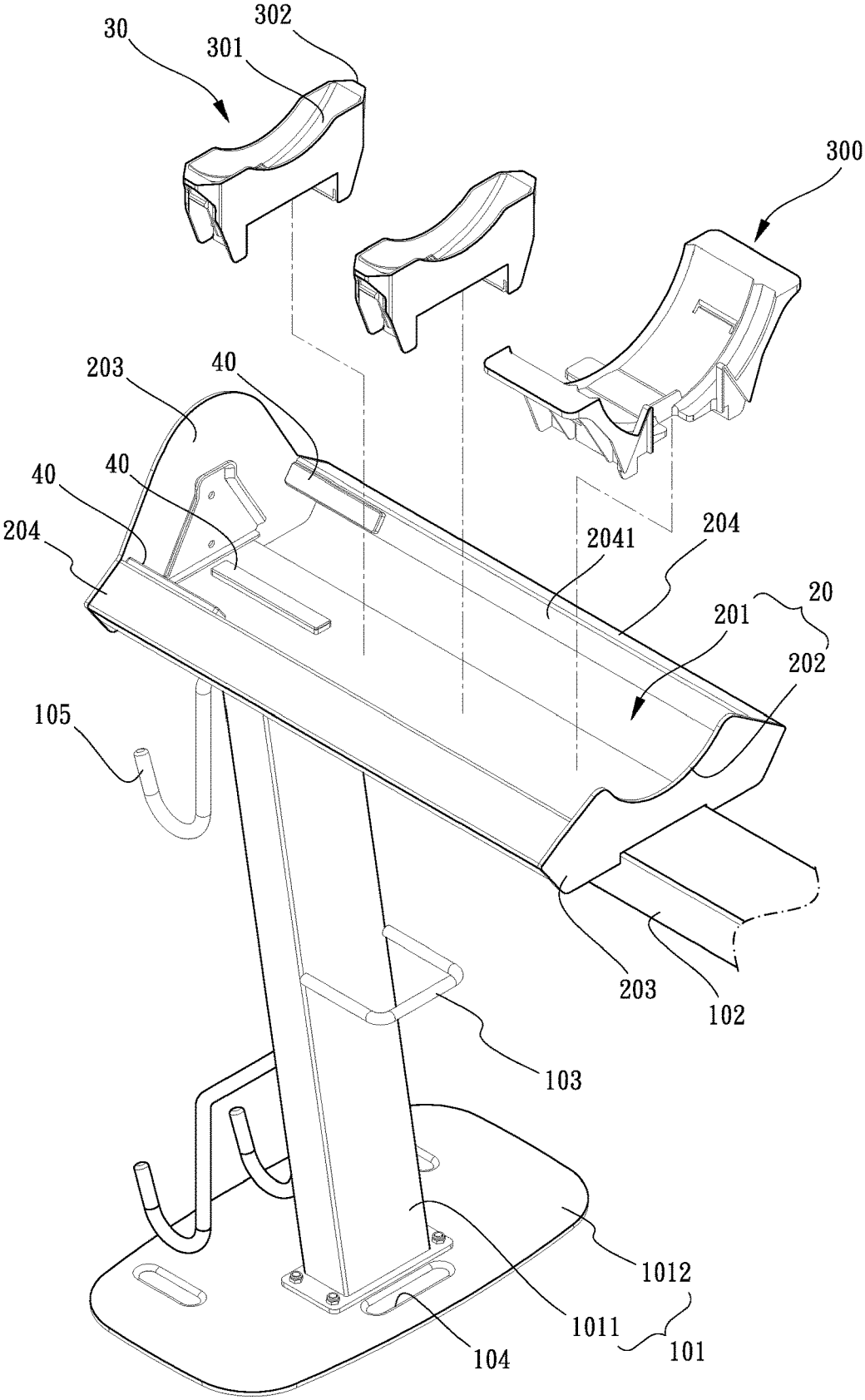
FIG. 2 is a perspective exploded view of a part of a first embodiment of the present invention.
Figure 3:
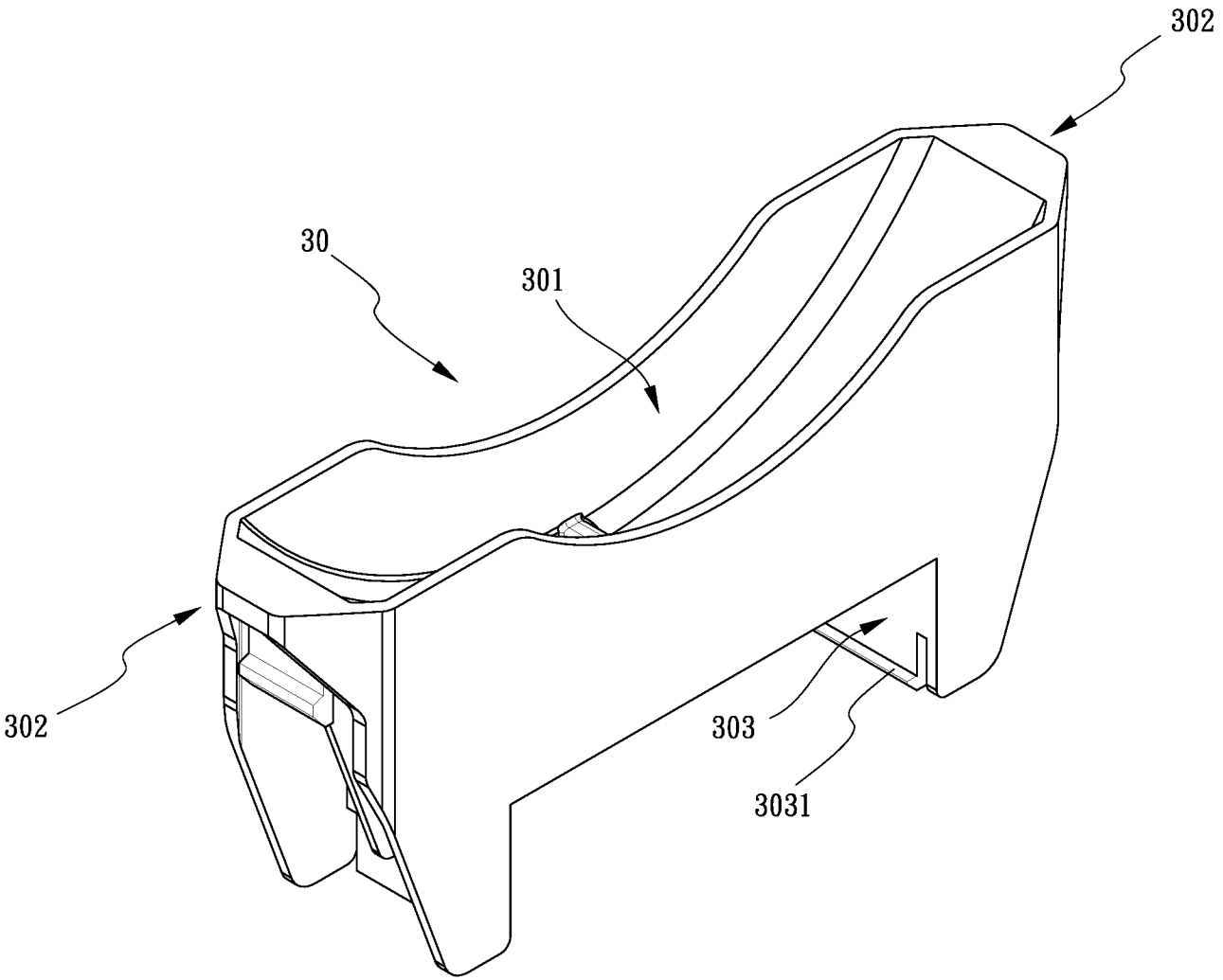
FIG. 3 is a perspective view of a placement base of a first embodiment of the present invention.
Figure 4:
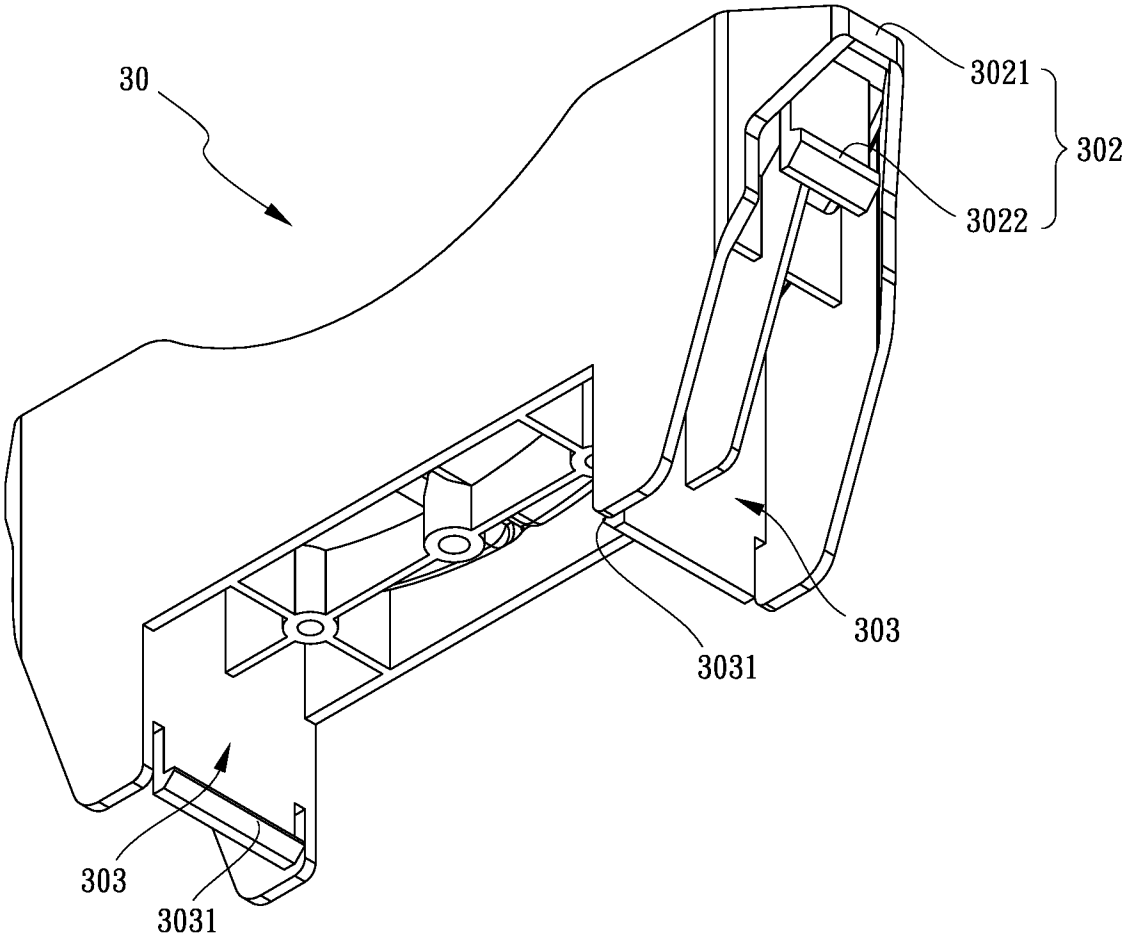
FIG. 4 is a perspective view of FIG. 3, when viewed from another angle.

The placement base includes cushions 40 disposed on the top of the rod 102 corresponding in position to the opening 202, and surfaces of the fastening parts 2041 of the two stop rods 204, respectively. Each of the cushions 40 is configured to cushion a weight of the weight element group 300 placed on the rod 102, so that each of the placed weight element groups 300 is prevented from colliding the rod 102 and the stop rod 204, as shown in FIG. 2.

Please refer to FIG. 11 to FIG. 18. The difference between the second embodiment and the first embodiment is that the conversion between the dumbbell 100 and the barbell 200. The picking manner used in the second embodiment is to connect the placement bases 30 in the same support member 20 to each other by a connection assembly 50, and when a user wants to convert the dumbbell 100 to the barbell 200, the user first puts the dumbbell 100 back on the placement base 30 and adjusts the dumbbell 100, and then picks and holds a holding part between the dumbbell 100 and the connection assembly 50 up. The placement bases 30 are connected to each other through the connection assembly 50, so the dumbbell 100 and the placement bases 30 together leave the support member 20 when the user picks the dumbbell 100 up. After putting the dumbbell 100 and the placement base 30 aside, the user can move one of weight element groups 300 in the same support member 20 close to another weight element group 300 for combination; next, the user picks up the barbell 200 and mounts the barbell 200 with the placement base 30, and combine the weight element group 300 according to the weight used by the user.

Each of the two connection assemblies 50 can include a pull rod 501 and at least one connection rod 502. The pull rod 501 is in an inverted-U shape, and has two lateral rods 5011 and an upper rod 5012. An end of each of the two lateral rods 5011 is connected on two ends of the upper rod 5012, and another end of the each of the two lateral rods 5011 is connected to an outer side of a corresponding one of the placement bases 30. The upper rod 5012 is disposed near the dumbbell 100. When the user wants to convert the dumbbell 100 into the barbell 200, the user can hold the holding part of the dumbbell 100 and the upper rod 5012 at the same time to picks the dumbbell 100 and the placement bases 30 together away from the support member 20. The at least one connection rod 502 is connected to the placement base 30 in the same support member 20, and the at least one connection rod 502 is arranged below the upper rod 5012 and configured to assist the pull rod 501 in sharing the supporting weight burden. In figures of the present invention, the two connection rods 502 are taken as an example for illustration, as shown in FIG. 12 to FIG. 15.

In the second embodiment, each of the two support members 20 has a bottom plate 205, two side plates 206 and a stop plate 207; the two side plates 206 are connected to two sides of the bottom plate 205, respectively, and each of the two side plates 206 is extended in an obliquely upward direction, and the two side plates 206 correspond in position to each other. The stop plate 207 is connected to an end of the bottom plate 205 and located between the two side plates 206, the bottom plate 205 has a long track hole 2051, and the rod 102 has cut holes 1022 in connection with each other and corresponding to the long track holes 2051, respectively. The bottom of one of the weight element groups 300 has a guiding rod 400 protruded thereon and inserted through the long track hole 2051 and the cut hole 1022. The weight element group 300 with the guiding rod 400 can be moved toward another weight element group 300, and the movement of the weight element group 300 in the long track hole 2051 and the cut hole 1022 is limited by the guiding rod 400, as shown in FIG. 15 to FIG. 18.

Besides the placement groove 301 of the first embodiment, each placement base 30 also includes two engaging parts 304 disposed on two ends thereof and opposite to the placement groove 301, each of the two side plates 206 has buckling parts 2061 corresponding to the engaging parts 304 of each placement base 30, each buckling part 2061 is in a notch shape, each engaging part 304 is in a sheet shape, each placement base 30 is put in the placement slot 201 of the support member 20, and the engaging part 304 can be engaged with the corresponding buckling part 2061 for location restriction, as shown in FIG. 12 to FIG. 15.

in the first embodiment and the second embodiment, each foot part 101 further includes a pillar 1011 and a supporting plate 1012; an end of the pillar 1011 is connected to the rod 102, an end of the pillar 1011 is connected to the supporting plate 1012, and the supporting plates 1012 and the pillars 1011 are used to firmly support the dumbbell 100 and the barbell 200. At least one frame rib 103 is disposed on a side of the pillar 1011 and configured to place the barbell 200. Moreover, each supporting plate 1012 has a racking slot 104 recessed on a top thereof and located between the two pillars 1011 and configure to place another barbell 200. Furthermore, any one of the two foot parts 101 can include a hook assembly 105 disposed on the supporting plate 1012 and configured to place another dumbbell 100, as shown in FIG. 1 to FIG. 18.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A dumbbell and barbell supporting system, comprising:

a main support, comprising two foot parts, and a rod connected to the two foot parts, wherein the two foot parts are disposed on two ends of the rod, respectively;

two support members, mounted on the two ends of the rod and opposite to the two foot parts, respectively, wherein each of the two support members has a placement slot recessed on a top thereof toward a bottom thereof, the placement slot has an opening formed on a bottom thereof, and a part of the rod is exposed out of the opening; and placement bases, mounted in the placement slot, inserted through the opening and slidably assembled with the rod, wherein some of the placement bases disposed in one of the two support members are movable close to and away from each other along an arrangement direction of the rod, to perform conversion between a dumbbell mode and a barbell mode, wherein a weight element group is movably disposed between one of the placement bases and a sidewall of a closest one of the two placement slots.

2. The dumbbell and barbell supporting system according to claim 1, wherein each of the two support members further comprises two stop boards and two stop rods, the two stop boards are arranged in interval and corresponds in position to each other, and two ends of each of the two stop rods are connected to the two stop boards, respectively, the two stop boards and the two stop rods connected to each other form the placement slot with the opening, each of the two stop rods has a fastening part, and two ends of each of the placement bases are engaged with the fastening parts, respectively.

3. The dumbbell and barbell supporting system according to claim 2, wherein each of the placement bases comprises a placement groove recessed on a top thereof, two blocking parts, and two clamping parts opposite to the placement groove, wherein the two blocking parts are disposed on two ends of the placement base, and configure to engage with the fastening parts, respectively, and the two clamping parts are protruded on bottom of the each of the placement bases and slidably connected to two ends of the rod, respectively.

4. The dumbbell and barbell supporting system according to claim 3, wherein each of the two blocking parts further comprises an abutting rib and a hooking block, the abutting rib of each of the two blocking parts is abutted with a surface of a corresponding one of the fastening parts, and the hooking block is engaged with a distal end of the corresponding one of the fastening parts, each of the placement bases is engaged with one of the two blocking parts and one of the two fastening parts to prevent from shaking.

5. The dumbbell and barbell supporting system according to claim 3, wherein the rod has at least one sliding rail recessed correspondingly in position to each of the two clamping part, an end of each of the two clamping parts is connected to the bottom of the placement base, another end of the each of the two clamping parts is extended toward a side of the at least one rod, and the extended end of the clamping part has a slider protruded thereon and inserted into the sliding rail on the side of the rod.

6. The dumbbell and barbell supporting system according to claim 2, wherein each of the placement bases comprises cushions disposed on a top of the rod and corresponding in position to the opening, and surfaces of the fastening parts of the two stop rods, respectively, wherein each of the cushions is configured to cushion a weight of the weight element group placed on the rod.

7. A dumbbell and barbell supporting system, comprising:

providing a switched-capacitor circuit to receive an input voltage from an input terminal and generate an output voltage at an output terminal;

a main support, comprising two foot parts, and a rod connected to the two foot parts, wherein the two foot parts are disposed on two ends of the rod, respectively;

two support members, mounted on the two ends of the rod and opposite to the two foot parts, wherein each of the two support members has a placement slot recessed on a top thereof toward a bottom thereof;

placement bases, mounted in the two placement slots, respectively, wherein some of the placement bases disposed in one of the two support members are connected to a connection assembly, and weight element groups are movably mounted in two sides of each of the placement slots, respectively, two ends of a dumbbell are placed in the placement bases in one of the two support members and movably connected to the weight element groups, respectively, wherein before the conversion from a dumbbell mode to a barbell mode, the dumbbell, the connection assembly and the placement base together are taken away from the one of the two support members, and moved and arranged in parallel to combine the weight element groups, and two ends of the barbell is put in the placement slots to movably connect to the weight element groups, respectively.

8. The dumbbell and barbell supporting system according to claim 7, wherein each of the connection assemblies further comprises a pull rod and at least one connection rod, the pull rod comprises two lateral rods and an upper rod, an end of each of the two lateral rods is connected on a corresponding one of two ends of the upper rod, and another end of the each of the two lateral rods is connected to an outer side of a corresponding one of the placement bases, and the upper rod is disposed near the dumbbell, and the at least one connection rod is connected to the placement bases in one of the two support members and is arranged below the upper rod.

9. The dumbbell and barbell supporting system according to claim 7, wherein each of the two support members further comprises a bottom plate, two side plates, and a stop plate, the two side plates are connected to two sides of the bottom plate and corresponding in position to each other, respectively, and the stop plate is connected to an end of the bottom plate and located between the two side plates, the bottom plate has a long track hole, the rod has cut holes in connection with each other and corresponding to the long track hole, a bottom of one of the weight element groups has a guiding rod protruded thereon and inserted through the long track hole and the cut holes, and movable toward another of the weight element groups with restriction of the guiding rod.

10. The dumbbell and barbell supporting system according to claim 9, wherein each of the placement bases has a placement groove recessed on a top thereof, and two engaging parts disposed on two ends thereof and opposite to the placement groove, each of the two side plates has buckling parts corresponding to the engaging parts of the placement bases, each of placement bases is put in the placement slot of one of the two support members, and engaged with the buckling parts through the two engaging parts for location restriction.

* * * * *